US011647335B2

(12) United States Patent
Liang et al.

(10) Patent No.: US 11,647,335 B2
(45) Date of Patent: May 9, 2023

(54) SPEAKER DEVICE

(71) Applicant: AAC Microtech (Changzhou) Co., Ltd., Changzhou (CN)

(72) Inventors: Ping Liang, Shenzhen (CN); Bin Zhao, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,716

(22) Filed: Nov. 26, 2021

(65) Prior Publication Data

US 2022/0174419 A1 Jun. 2, 2022

(30) Foreign Application Priority Data

Nov. 30, 2020 (CN) ..... 202011375274.0

(51) Int. Cl.
*H04R 9/04* (2006.01)
*H04R 9/02* (2006.01)
*H04R 9/06* (2006.01)

(52) U.S. Cl.
CPC ..... *H04R 9/045* (2013.01); *H04R 9/025* (2013.01); *H04R 9/06* (2013.01); *H04R 2400/11* (2013.01)

(58) Field of Classification Search
CPC ..... H04R 9/045; H04R 9/025; H04R 9/06; H04R 2400/11; H04R 7/20; H04R 7/00
See application file for complete search history.

(56) References Cited

U.S. PATENT DOCUMENTS

2020/0213761 A1* 7/2020 Xiao ..... H04R 7/04

FOREIGN PATENT DOCUMENTS

| | | | | |
|---|---|---|---|---|
| CN | 209390315 U | * | 9/2019 | ..... H04R 7/12 |
| CN | 111093138 A | * | 5/2020 | ..... H04R 7/02 |
| CN | 211531289 U | * | 9/2020 | |
| CN | 211531292 U | * | 9/2020 | |
| CN | 211531294 U | * | 9/2020 | |

* cited by examiner

*Primary Examiner* — Angelica M McKinney
(74) *Attorney, Agent, or Firm* — W&G Law Group

(57) ABSTRACT

The present disclosure provides speaker device. The speaker device includes frame, vibration unit fixed to frame and magnetic circuit unit driving vibration unit to vibrate and produce sound, where magnetic circuit unit is provided with magnetic gap; vibration unit includes diaphragm, voice coil inserted in magnetic gap to drive diaphragm to vibrate and holder connected to diaphragm; side of frame close to diaphragm is at least partially embedded into diaphragm; first surface is formed on side of frame away from diaphragm; second surface is formed on side of diaphragm close to magnetic circuit unit. The present disclosure solves problem of glue overflow of holder by means of reserved space between frame and diaphragm. In addition, by using first surface of holder as supporting surface, present disclosure improves dimensional consistency of gluing with flexible printed circuit (FPC), etc., thereby improving product yield.

5 Claims, 3 Drawing Sheets

SPEAKER DEVICE

TECHNICAL FIELD

The present disclosure relates to the field of electro-acoustic conversion, in particular to a speaker device.

BACKGROUND

With the advent of the Internet era, the number of mobile terminal devices continues to rise. Mobile phones are undoubtedly the most common and most portable mobile terminal devices. Speaker devices are widely used in mobile terminal devices such as mobile phones for playing music, etc. The vibration unit is an important part of the speaker device, which enables the entire speaker device to vibrate and produce sound.

In the related art, a speaker device includes a frame, a vibration unit fixed to the frame and a magnetic circuit unit driving the vibration unit to vibrate and produce sound. The vibration unit includes a diaphragm and a voice coil driving the diaphragm to vibrate and produce sound. The diaphragm is fixed to the frame by glue.

When the diaphragm and the frame are fixed by glue, the glue is prone to overflow. In addition, the bottom of the diaphragm is usually coated with a material. After the diaphragm and the frame are fixed by glue, the bottom surface of the coating material is lower than that of the frame, and the bottom surface of the coating material is used as a supporting surface during subsequent mounting, which results in low dimensional consistency of gluing with a flexible printed circuit (FPC), etc., thereby leading to low product yield.

Therefore, it is necessary to provide a speaker device to solve the above problem.

SUMMARY

An objective of the present disclosure is to provide a speaker device, which solves the problem of glue overflow and improves the product yield.

In order to achieve the above objective, the present disclosure provides a speaker device. The speaker device includes a frame, a vibration unit fixed to the frame and a magnetic circuit unit driving the vibration unit to vibrate and produce sound, and the magnetic circuit unit is provided with a magnetic gap; the vibration unit includes a diaphragm, a voice coil inserted in the magnetic gap to drive the diaphragm to vibrate and a holder connected to the diaphragm; a side of the frame close to the diaphragm is at least partially embedded into the diaphragm; a first surface is formed on a side of the frame away from the diaphragm; a second surface is formed on a side of the diaphragm close to the magnetic circuit unit; a reference surface is formed on a side of the magnetic circuit unit away from the diaphragm; and a distance between the first surface and the reference surface along a vibrating direction of the diaphragm is smaller a distance between the second surface and the reference surface along the vibrating direction of the diaphragm.

As an improvement, the diaphragm may include a vibrating portion provided with a through hole, a suspension portion extending from a periphery of the vibrating portion and surrounding the vibrating portion and a fixing portion bending and extending from a side of the suspension portion away from the vibrating portion along the vibrating direction of the diaphragm and fixed to the frame; and the second surface may be formed on a side of the fixing portions away from the vibrating portion.

As an improvement, the fixing portion may include a first fixing portion bending and extending from the suspension portion and fixed to a top of the frame, a second fixing portion bending and extending from an outer periphery of the first fixing portion along the vibrating direction of the diaphragm and fixed to an outer side surface of the frame and a third fixing portion that may be directly opposite to and spaced apart from the second fixing portion; and the frame may be interposed between the second fixing portion and the third fixing portion.

As an improvement, the second surface may be formed on a side of the third fixing portion away from the first fixing portion; a third surface may be formed on a side of the second fixing portion away from the first fixing portion; and a distance between the second surface and the reference surface along the vibrating direction of the diaphragm may be smaller than a distance between the third surface and the reference surface along the vibrating direction of the diaphragm.

As an improvement, the fixing portion may further include a gluing member that may be provided on a side of the third fixing portion away from the first fixing portion; and the second surface may be formed on a side of the gluing member away from the first fixing portion.

As an improvement, the vibration unit may further include an elastic support assembly fixed to the frame; and the elastic support assemblies each may include an elastic piece fixed to the frame and an auxiliary diaphragm fitted to the elastic piece.

As an improvement, the auxiliary diaphragm may be fitted to a side of the elastic piece away from the diaphragm.

As an improvement, the frame may be made of a metal material.

The present disclosure has the following beneficial effects. The first surface is formed on a side of the frame away from the diaphragm, the second surface is formed on a side of the diaphragm close to the magnetic circuit unit, and the reference surface is formed on a side of the magnetic circuit unit away from the diaphragm. The distance between the first surface and the reference surface along the vibrating direction of the diaphragm is smaller than the distance between the second surface and the reference surface along the vibrating direction of the diaphragm. In this way, a reserved space can be formed between the frame and the diaphragm to solve the problem of glue overflow of the frame. The distance between the first surface and the reference surface along the vibrating direction of the diaphragm is smaller than the distance between the second surface and the reference surface along the vibrating direction of the diaphragm. Therefore, during a subsequent mounting process, the first surface of the frame is used as a supporting surface, which improves the dimensional consistency for gluing with a flexible printed circuit (FPC), etc., thereby improving the product yield.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

Figure 1:
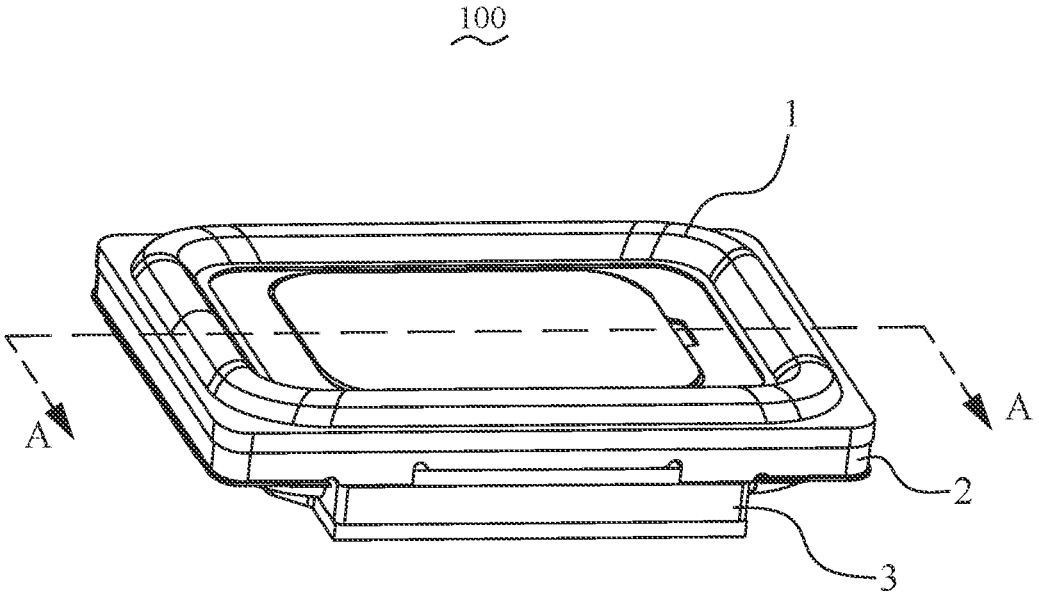
FIG. 1 is a view illustrating a structure of a speaker device according to the present disclosure.

The present disclosure is further described below with reference to the drawings and implementations.

It should be noted that all directional indications (such as upper, lower, left, right, front, back, inner, outer, top and bottom) in the embodiments of the present disclosure are merely intended to explain relative position relationships of components in a specific position (as shown in the figures). If the specific position changes, the directional indication changes accordingly.

It should be noted that when a component is "fixed" or "provided" on the other component, the component may be fixed on the other component directly or via an intermediate component. When a component is connected to the other component, the component may be connected to the other component directly or via an intermediate component.

Referring to FIGS. 1 to 5, the present disclosure provides a speaker device 100. The speaker device includes a frame 1, a vibration unit 2 fixed to the frame 1 and a magnetic circuit unit 3 driving the vibration unit 2 to vibrate and produce sound. The magnetic circuit unit 3 is provided with a magnetic gap.

Specifically, the vibration unit 2 includes a diaphragm 21, a voice coil 22 inserted in the magnetic gap to drive the diaphragm 21 to vibrate and a holder 23 connected to the diaphragm 21. A side of the frame 1 close to the diaphragm 21 is at least partially embedded into the diaphragm 21. A first surface 11 is formed on a side of the frame 1 away from the diaphragm 21. A second surface 210 is formed on a side of the diaphragm 21 close to the magnetic circuit unit 3. A reference surface 31 is formed on a side of the magnetic circuit unit 3 away from the diaphragm 21. A distance between the first surface 11 and the reference surface 31 along a vibrating direction of the diaphragm 21 is smaller than a distance between the second surface 210 and the reference surface 31 along the vibrating direction of the diaphragm 21. In this way, a reserved space is formed between the frame 1 and the diaphragm 21 to solve the problem of glue overflow of the frame 1. Meanwhile, during subsequent mounting, the first surface 11 of the frame 1 is used as a supporting surface, which improves the dimensional consistency for gluing with a flexible printed circuit (FPC), etc.

Figure 3:
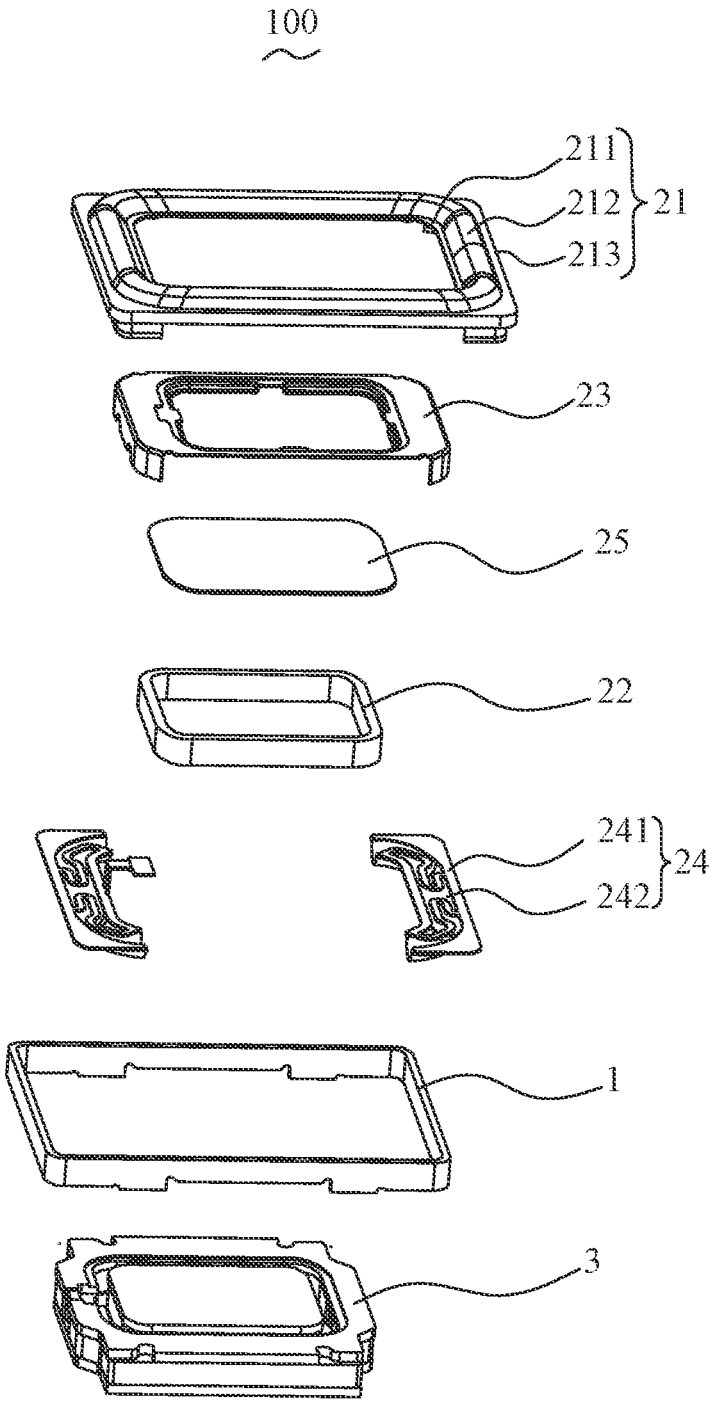
FIG. 3 is an exploded view of the speaker device shown in FIG. 1.

Further, referring to FIG. 3, the diaphragm 21 includes a vibrating portion 211 provided with a through hole, a suspension portion 212 extending from a periphery of the vibrating portion 211 and surrounding the vibrating portion 211 and a fixing portion 213 bending and extending from a side of the suspension portion 212 away from the vibrating portion 211 along the vibrating direction of the diaphragm 21 and fixed to the frame 1. The second surface 210 is formed on a side of the fixing portions 213 away from the vibrating portion 211, such that the reserved space is formed between the frame 1 and the fixing portion 213.

Figure 4:
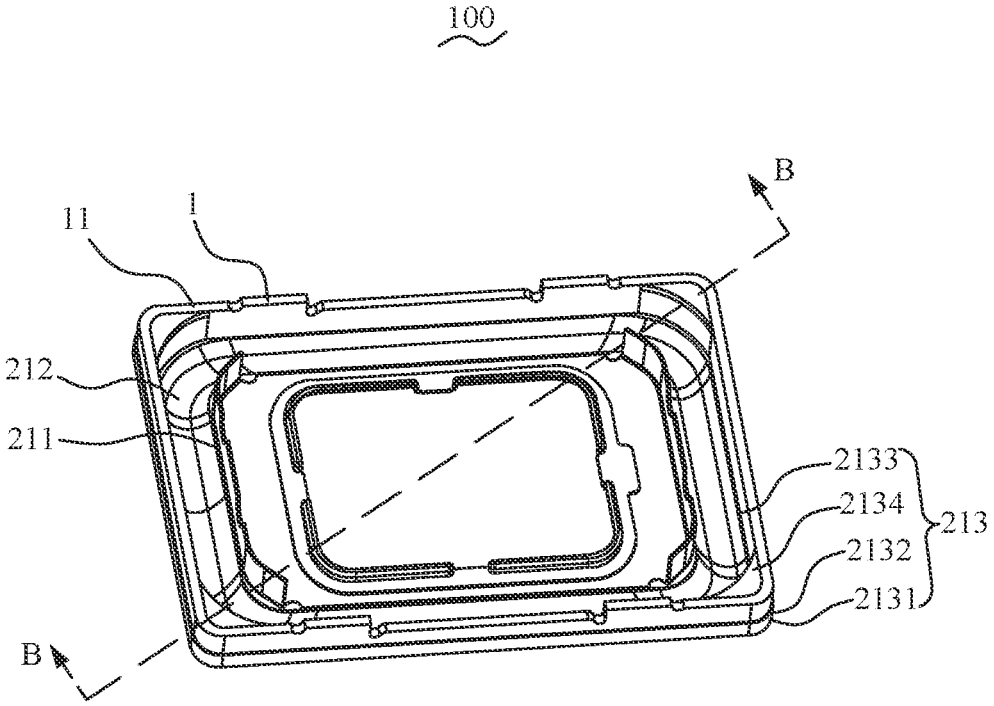
FIG. 4 is a partial view of the speaker device shown in FIG. 1.

Referring to FIG. 4, the fixing portion 213 includes a first fixing portion 2131 bending and extending from the suspension portion 212 and fixed to a top of the frame 1, a second fixing portion 2132 bending and extending from an outer periphery of the first fixing portion 2131 along the vibrating direction of the diaphragm 21 and fixed to an outer side surface of the frame 1, and a third fixing portion 2133 that is directly opposite to and spaced apart from the second fixing portion 2132. The frame 1 is interposed between the second fixing portion 2132 and the third fixing portion 2133, such that the side of the frame 1 close to the diaphragm 21 is at least partially embedded into the diaphragm 21.

As an improvement, the second surface 210 is formed on a side of the third fixing portion 2133 away from the first fixing portion 2131, such that a reserved space is formed between the frame 1 and the third fixing portion 2133. This design solves the problem of glue overflow of the frame 1, and improves the dimensional consistency of gluing with an FPC, etc. A third surface 21321 is formed on a side of the second fixing portion 2132 away from the first fixing portion 2131. A distance between the second surface 210 and the reference surface 31 along the vibrating direction of the diaphragm 21 is smaller than that the distance between the third surface 21321 and the reference surface 31 along the vibrating direction of the diaphragm 21, so as to form the fixing portion 213.

Figure 5:
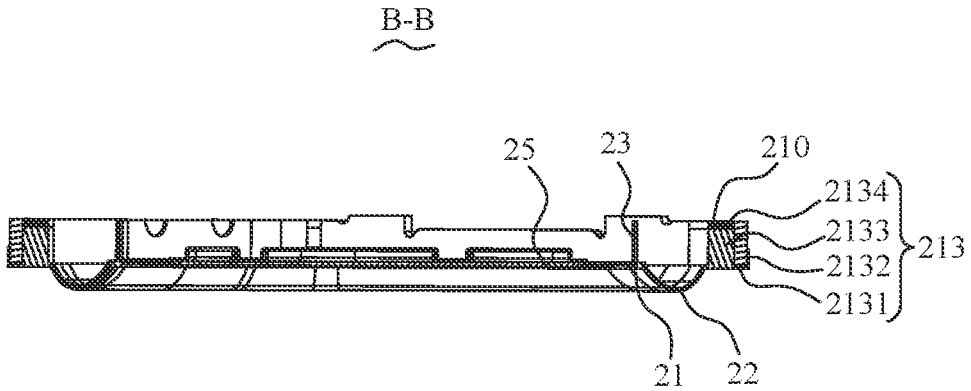
FIG. 5 is a sectional view taken along line B-B in FIG. 4.

Referring to FIG. 5, the fixing portion 213 further include a gluing member 2134 that is provided on a side of the third fixing portion 2133 away from the first fixing portion 2131. The second surface 210 is formed on a side of the gluing member 2134 away from the first fixing portion 2131 to form a reserved space. Meanwhile, the first surface 11 of the frame 1 is used as a supporting surface, which improves the dimensional consistency of gluing with an FPC, etc.

Figure 2:
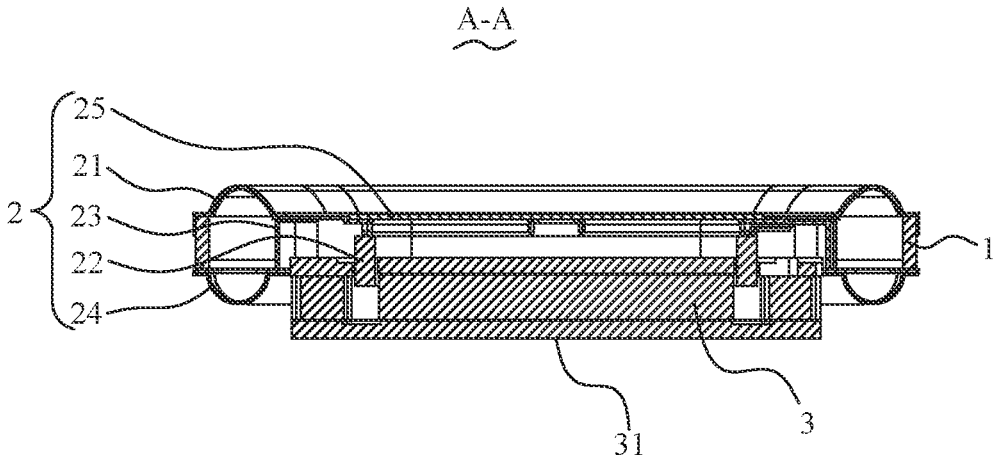
FIG. 2 is a sectional view taken along line A-A in FIG. 1.

Referring to FIG. 2, the vibration unit 2 further includes an elastic support assembly 24 fixed to the frame 1. The elastic support assembly 24 include an elastic piece 241 fixed to the frame 1 and an auxiliary diaphragm 242 fitted to the elastic piece 241. The auxiliary diaphragm 242 is fitted to a side of the elastic piece 241 away from the diaphragm 21. This structure avoids lateral swing of the voice coil 22, thereby improving the stability of the speaker device 100.

In this implementation, the frame 1 is made of a metal material. This structure increases an overall rigidity of the speaker device, and further improves the acoustic performance of the speaker device.

In an implementation, the frame 1, the diaphragm 21 and the holder 23 may be integrally injection-molded. This structure avoids the adverse effect of glue on the performance, thereby improving the acoustic performance of the speaker device 100. It also avoids assembly errors, simplifies the assembly process and improves the production efficiency.

In the speaker device 100 of the present disclosure, the first surface 11 is formed on a side of the frame 1 away from the diaphragm 21. The second surface 210 is formed on a side of the diaphragm 21 close to the magnetic circuit unit 3. The reference surface 31 is formed on a side of the magnetic circuit unit 3 away from the diaphragm 21. The distance between the first surface 11 and the reference surface 31 along the vibrating direction of the diaphragm 21 is smaller than the distance between the second surface 210 and the reference surface 31 along the vibrating direction of the diaphragm 21. In this way, a reserved space is formed between the frame 1 and the diaphragm 21 to solve the problem of glue overflow of the frame 1. The distance between the first surface 11 and the reference surface 31 along the vibrating direction of the diaphragm 21 is smaller than the distance between the second surface 210 and the reference surface 31 along the vibrating direction of the diaphragm 21. Therefore, during subsequent mounting, the first surface 11 of the frame 1 is used as a supporting surface, which improves the dimensional consistency of gluing with an FPC, etc., thereby improving the product yield.

The above described are merely implementations of the present disclosure. It should be noted here that those of ordinary skill in the art may make improvements without departing from the concept of the present disclosure, but such improvements should fall within the protection scope of the utility model.

What is claimed is:

1. A speaker device, comprising a frame, a vibration unit fixed to the frame and a magnetic circuit unit driving the vibration unit to vibrate and produce sound, wherein the magnetic circuit unit is provided with a magnetic gap; the vibration unit comprises a diaphragm, a voice coil inserted in the magnetic gap to drive the diaphragm to vibrate, and a holder connected to the diaphragm; wherein a side of the frame close to the diaphragm is at least partially embedded into the diaphragm; a first surface is formed on a side of the frame away from the diaphragm; a second surface is formed on a side of the diaphragm close to the magnetic circuit unit; a reference surface is formed on a side of the magnetic circuit unit away from the diaphragm; and a distance between the first surface and the reference surface along a vibrating direction of the diaphragm is smaller than a distance between the second surface and the reference surface along the vibrating direction of the diaphragm, wherein the diaphragm comprises a vibrating portion provided with a through hole, a suspension portion extending from a periphery of the vibrating portion and surrounding the vibrating portion, and a fixing portion bending and extending from a side of the suspension portion away from the vibrating portion along the vibrating direction of the diaphragm and fixed to the frame; and the second surface is formed on a side of the fixing portion away from the vibrating portion; the fixing portion comprises a first fixing portion bending and extending from the suspension portion and fixed to a top of the frame, a second fixing portion bending and extending from an outer periphery of the first fixing portion along the vibrating direction of the diaphragm and fixed to an outer side surface of the frame, and a third fixing portion that is directly opposite to and spaced apart from the second fixing portion; and the frame is interposed between the second fixing portion and the third fixing portion, the fixing portion further comprises a gluing member that is provided on the side of the third fixing portion away from the first fixing portion; and the second surface is formed on a side of the gluing member away from the first fixing portion.

2. The speaker device as described in claim 1, wherein the second surface is formed on a side of the third fixing portion away from the first fixing portion; a third surface is formed on a side of the second fixing portion away from the first fixing portion; and the distance between the second surface and the reference surface along the vibrating direction of the diaphragm is smaller than a distance between the third surface and the reference surface along the vibrating direction of the diaphragm.

3. The speaker device as described in claim 1, wherein the vibration unit further comprises an elastic support assembly fixed to the frame; and the elastic support assembly comprises an elastic piece fixed to the frame and an auxiliary diaphragm fitted to the elastic piece.

4. The speaker device as described in claim 3, wherein the auxiliary diaphragm is fitted to a side of the elastic piece away from the diaphragm.

5. The speaker device as described in claim 1, wherein the frame is made of a metal material.

* * * * *